US006382186B1

(12) United States Patent
Kulovits et al.

(10) Patent No.: US 6,382,186 B1
(45) Date of Patent: May 7, 2002

(54) INTERNAL COMBUSTION ENGINE FUEL INJECTION VALVE

(75) Inventors: Walter Kulovits, Leutkirch; Juergen Gottschling, Remseck; Werner Teschner, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,920

(22) PCT Filed: Dec. 7, 1998

(86) PCT No.: PCT/DE98/03579

§ 371 Date: Dec. 1, 1999

§ 102(e) Date: Dec. 1, 1999

(87) PCT Pub. No.: WO99/50553

PCT Pub. Date: Oct. 7, 1999

(30) Foreign Application Priority Data

Apr. 1, 1998 (DE) ..... 198 14 501

(51) Int. Cl.[7] ..... F02M 55/02
(52) U.S. Cl. ..... 123/469; 123/468
(58) Field of Search ..... 123/469, 468, 123/470; 285/133.4, 13, 14

(56) References Cited

U.S. PATENT DOCUMENTS 3,845,748 A * 11/1974 Eisenberg ..... 123/32
4,624,487 A * 11/1986 Thalmann ..... 285/197
4,846,406 A * 7/1989 Christy ..... 239/542
5,365,907 A * 11/1994 Dietrich et al. ..... 123/470
6,126,208 A * 10/2000 Asada et al. ..... 285/133.4

FOREIGN PATENT DOCUMENTS

| | | | |
|---|---|---|---|
| DE | 9206268 | * | 9/1993 |
| EP | 0889231 | * | 1/1999 |
| FR | 2429900 | * | 1/1980 |

* cited by examiner

*Primary Examiner*—Gene Mancene
*Assistant Examiner*—Mahmoud Gimie
(74) *Attorney, Agent, or Firm*—Ronald E. Greigg

(57) ABSTRACT

A fuel injection valve for internal combustion engines, having a holder body, which can be braced with a valve body that protrudes into the engine combustion chamber. A fuel inflow conduit extending from one end is provided that is formed by a longitudinal bore and a transverse bore that intersects the longitudinal bore. The injection port of the transverse bore forms a lateral pressure connection on a radial circumferential wall of the holder body for a fuel delivery line. In the region of a radial circumferential wall face opposite the lateral pressure connection, the holder body has a radially inward-pointing flat face.

8 Claims, 1 Drawing Sheet

INTERNAL COMBUSTION ENGINE FUEL INJECTION VALVE

PRIOR ART

The invention is based on a fuel injection valve for internal combustion engines. In one such fuel injection valve, known from German Utility Model 92 06 268.7, a valve body of the injection valve is axially secured with a tightening nut to a holder body that is inserted into the housing of the engine to be supplied. The valve body, on its free end, has at least one injection port protruding into the engine combustion chamber; this injection port adjoins a fuel inflow conduit extending in the valve body and the holder body, and it can communicate with the valve body by means of a movable valve member inside the valve body. The fuel inflow conduit in the holder body is formed by an axial longitudinal bore that discharges into the end face of the holder body facing toward the valve body and by a radial transverse bore intersecting the longitudinal bore; the injection port of the transverse bore forms a lateral pressure connection, on the radial circumferential wall face of the holder body, for a fuel delivery line that leads away from a high-pressure fuel pump. A pressure neck located at the lateral pressure connection formed at the injection port of the transverse bore connects the external fuel delivery line with the holder body. This pressure neck is braced against the holder body in the axial direction and radially to the axis of the holder body via tightening screws, and the holder body has to absorb all of these chucking forces.

The known fuel injection valve has the disadvantage that because of the chucking forces of the pressure neck on the lateral pressure connection that have to be absorbed, very high static stresses occur in the region of the bore intersection of the vertical longitudinal bore and the horizontal transverse bore of the fuel conduit inside the holder body. Under these static loads, it is of major significance whether they cause compressive or tensile stresses in the holder body; in the known fuel injection valve, the force introduction axis forms only a line on the circumferential wall and thus generates very great tensile stresses in the region of the bore intersection; this lowers the allowable pressure threshold value in this region.

At very high operating loads on the fuel injection valve, especially at high fuel pressures of over 1800 bar, the high static stresses, which occur particularly in the form of tangential tensile stresses in the region of the aforementioned bore intersection, lead to permanent breaks in the region of the bore intersection and thus to failure of the applicable fuel injection valves, making them unsuitable to use in injection systems that employ very high fuel injection pressures.

The risk of component failure in the holder body is still further increased by an oscillatory stress, such as from a pulsating internal pressure in the fuel conduit in cooperation with the high internal fuel pressure inside the fuel conduit and the static prestressing in the holder body.

ADVANTAGES OF THE INVENTION

The fuel injection valve for internal combustion engines according to the invention has the advantage over the prior art that line pressure, as in the known holder body, can be avoided, and opposite the bore intersection of the fuel conduit in the holder body, two line contacts are formed, laterally offset from the bore intersection, on the radial circumferential wall face opposite the lateral pressure connection. This is advantageously effected by the provision of an indented protrusion in the circumferential wall of the holder body, on its radial cs region opposite the lateral pressure connection. In this way, within the deformation and tension region, a tightening torque is generated that counteracts widening of the bore. This tightening torque is formed of the resultant forces at the holder body, which counteract the chucking force of the pressure neck on the lateral pressure connection. In addition to the contrary force that counteracts the axial chucking force on one axis, a force component extending at right angles to the contrary force also occurs, so that the aforementioned tension moments that counteract widening of the fuel inflow conduit bore are generated. In this way, lesser deformation and thus reduced tensile stress can be achieved inside the valve body, so that the bracing of the pressure neck on the lateral pressure connection no longer increases the inherent stresses, and in particular the tensile stresses of the holder body, to an impermissible extent. This reduction of the inherent stresses in the holder body leads to greater strength and thus a longer service life of the holder body of the fuel injection valve of the invention, even at operating pressures of up to 2000 bar and under alternating oscillatory stress.

The indented protrusion opposite the lateral pressure connection on the holder body is preferably embodied as material erosion from the radial circumferential wall of the holder body, but it is alternatively possible to incorporate this feature into the original forming of the holder body. The material erosion of the indented protrusion on the holder body is preferably embodied as a plane ground section, and the transition edges formed between the plane ground section and the remaining radial circumferential wall region of the holder body are located outside a force introduction axis of the lateral pressure connection. With this shifting of the line of contact on the radial circumferential wall to two lateral lines of contact, the material comprising the holder body is positively displaced inward by the aforementioned tightening moment, and the result is that tensile stresses are reduced, or that compressive stresses now occur in the region of the bore intersection that counteract its widening. This is especially advantageously effective in high-strength materials with a high mean stress vulnerability (such as 42CRM04PB).

The lateral pressure connection on the holder body can, as shown for the exemplary embodiment, be disposed perpendicular to the axis of the holder body, but an inclined placement is also possible as an alternative. A plane ground section is also shown and described in the exemplary embodiment, but the indented protrusions on the circumference of the holder body can alternatively take other forms as well, such as crowned or convex surfaces.

With the fuel injection valve of the invention, it is thus possible to increase the resistance of the holder body to oscillatory stresses and static loads considerably, without increasing the space originally required for installing the fuel injection valve.

Further advantages and advantageous features of the subject of the invention can be learned from the drawing, the description and the claims.

BRIEF DESCRIPTION OF THE DRAWING

One exemplary embodiment of the fuel injection valve of the invention for internal combustion engines is shown in the drawing and will be described in further detail in the ensuing description.

DESCRIPTION OF THE EXEMPLARY EMBODIMENT

Figure 1:
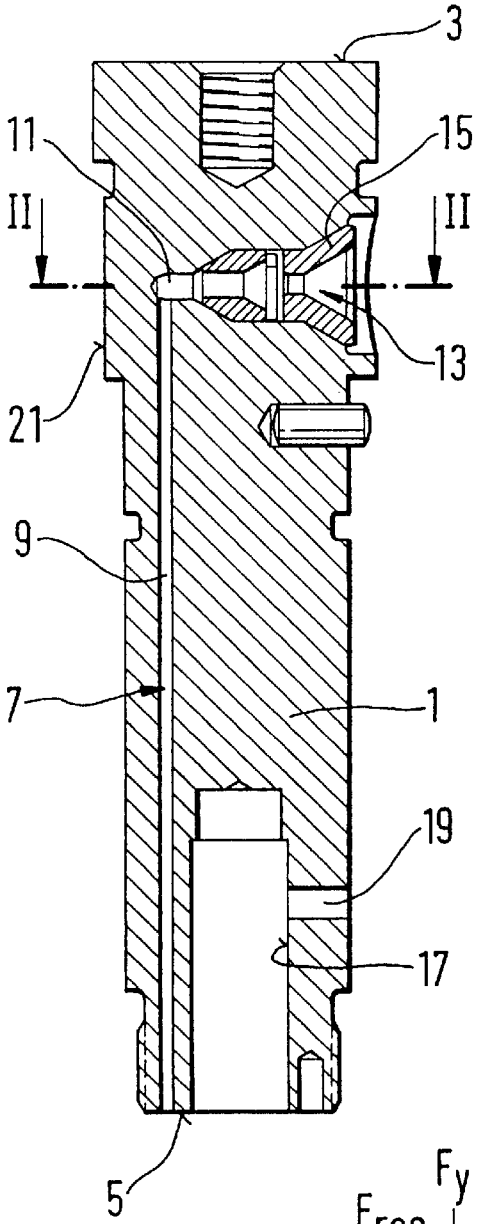
FIG. 1 shows a longitudinal section through a holder body of the fuel injection valve of the invention.
Figure 2:
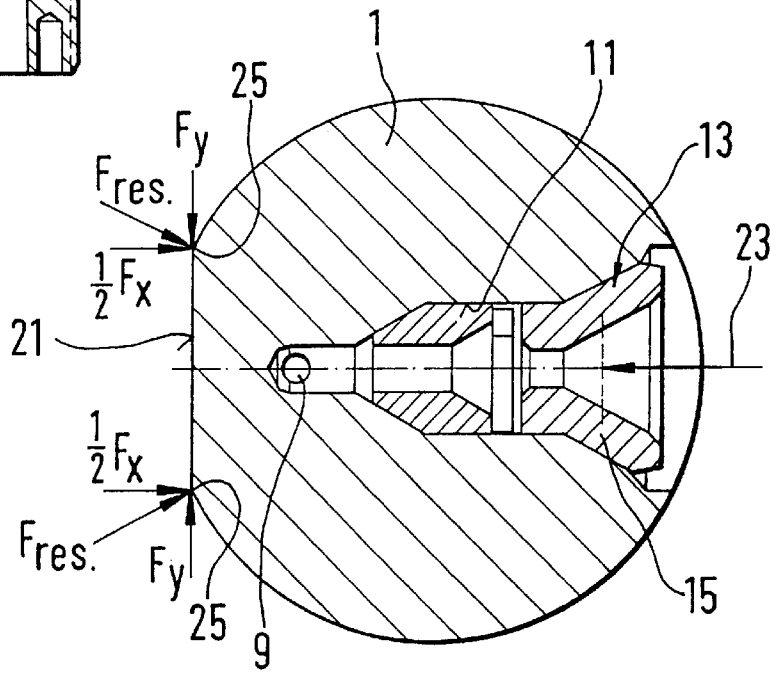
FIG. 2 shows a cross section through the holder body of FIG. 1 taken along the lines II.

The description of the fuel injection valve of the invention shown in FIG. 1 and in a detail thereof in FIG. 2 is limited to the description of a holder body 1 of the fuel injection valve that is required for defining the invention. This holder body 1 has a cylindrical basic shape, whose upper axial end face 3 is engaged, in a manner not shown, by a tightening screw or claw, which presses the holder body 1 with its axial lower end face 5 axially against a valve body, not shown. For delivering fuel to the valve body not shown, a fuel inflow conduit 7 is provided in the holder body 1; it is formed by an axial longitudinal bore 9 that originates at the lower end face 5 and by a radial transverse bore 11 that intersects the longitudinal bore. The injection port of the radial transverse bore 11 forms a lateral pressure connection 13 on the radial circumferential wall face of the holder body 1. This lateral pressure connection 13 has an outward pointing conical cross-sectional expansion of the radial transverse bore 11, into which a pressure connection sleeve 15 is inserted whose conical inside diameter serves as a receiving face for a pressure neck of a fuel delivery line, which leads from a high-pressure fuel pump, not shown, and discharges at the lateral pressure connection 13 of the holder body 1 and thus supplies the holder body with fuel at high pressure.

A central blind bore 17 is also made in the holder body from the lower end face 5 of the holder body 1 and serves to receive a restoring element, preferably a valve spring of the fuel injection valve; a leakage bore 19 leads away from the central blind bore 17.

To improve the inherent stresses of the holder body when the holder body absorbs forces originating in the bracing, oriented radially to the holder body axis, of the high-pressure line connection on the lateral pressure connection 13, the radial circumferential face of the holder body is flattened in the wall region opposite the lateral pressure connection 13. This flat face 21, shown in further detail in FIG. 2, is embodied as a plane ground section, which in the exemplary embodiment is oriented perpendicular to a force introduction axis 23 that characterizes the flow of a chucking force involved in chucking the high-pressure connection on the lateral pressure connection 13 and introducing the lateral pressure connection into the holder body 1. As a result of the plane ground section 21 on the radial circumferential wall of the holder body 1, transition edges 25 to the remaining circumferential wall of the holder body 1 are created, which extend outside the force introduction axis 23 of the lateral pressure connection 13.

As a result of this shifting of the chucking pressure lines to two laterally offset lines, the material comprising the holder body 1 is positively displaced inward with a tightening moment at the transition edges 25, so that the tensile stresses inside the holder body 1 can be dissipated. In this way compressive stresses also arise in the region of the bore intersection between the longitudinal bore 9 and the transverse bore 11 of the fuel inflow conduit 7, as a result of which the resistance to fluctuating compressive stresses, in terms of pulsating internal pressure inside the fuel inflow conduit 7, can be increased considerably. The contrary force F counteracting the chucking force 23 is now split into two force components extending perpendicular to one another, of which one force component $F_y$ extends perpendicular to the force introduction axis 23 and one force component $F_x$ extends in the direction of the force introduction axis 23, counteracting its chucking force. As shown in FIG. 2, a resultant force component $F_{res}$ is established at the transition edges 25; this component points into the holder body 1 in the direction of the longitudinal bore 9 and thus generates an advantageous compressive stress component in the holder body 1 that counteracts any possible widening of the longitudinal bore 9 or transverse bore 11 that the high internal fuel pressure might cause.

In this way, it is possible in a structurally simple way to increase the fatigue strength even at very high internal fuel pressures and high chucking forces at the lateral pressure connection 13, so that the fatigue strength of the entire fuel injection valve can be improved, without having to embody individual components with reinforcement for the purpose.

The foregoing relates to a preferred exemplary embodiment of the invention, it being understood that other variants and embodiments thereof are possible within the spirit and scope of the invention, the latter being defined by the appended claims.

We claim:

1. A fuel injection valve for internal combustion engines, comprising a holder body (1), which is braced with a valve body that protrudes into an engine combustion chamber, a fuel inflow conduit (7) extends from one end of the holder body to an injection port on the valve body, the fuel inflow conduit (7) in the holder body (1) being formed by a longitudinal bore (9) and a transverse bore (11) intersecting the inflow conduit, an injection port of the transverse bore forms a lateral pressure connection (13) on a radial circumferential wall of the holder body (1) for connection of a fuel delivery line, and the holder body (1) has a radially inward-pointing indented protrusion (21) in a region of a radial circumferential wall face opposite the lateral pressure connection (13).

2. The fuel injection valve according to claim 1, in which the indented protrusion (21) is embodied as a material erosion from the radial circumferential wall of the holder body (1).

3. The fuel injection valve according to claim 1, in which the indented protrusion (21) has transition edges (25) which extend outside a force introduction axis (23) of the lateral pressure connection (13) to the remainder of the radial circumferential wall of the holder body (1).

4. The fuel injection valve according to claim 2, in which the material erosion is embodied as a plane ground section.

5. The fuel injection valve according to claim 1, in which the transverse bore (11) of the fuel inflow conduit (7) extends in the holder body (1) perpendicular to a longitudinal axis thereof.

6. The fuel injection valve according to claim 3, in which the plane ground section (21) is disposed perpendicular to the force introduction axis (23) of the lateral pressure connection (13).

7. The fuel injection valve according to claim 4, in which the plane ground section (21) is disposed perpendicular to the force introduction axis (23) of the lateral pressure connection (13).

8. The fuel injection valve according to claim 3, in which the transition edges (25) between the indented protrusion (21) and the remaining radial circumferential wall region of the holder body (1) extend axially parallel to a longitudinal axis of the holder body (1).

* * * * *